US010473419B1

(12) United States Patent
Jones

(10) Patent No.: US 10,473,419 B1
(45) Date of Patent: Nov. 12, 2019

(54) ARCHERY RELEASE

(71) Applicant: H.I.T. Outdoors, LLC, Clay City, KY (US)

(72) Inventor: Brian K. Jones, Georgetown, KY (US)

(73) Assignee: H.I.T. Outdoors, LLC, Clay City, KY (US)

( * ) Notice: Subject to any disclaimer, the term of this patent is extended or adjusted under 35 U.S.C. 154(b) by 0 days.

(21) Appl. No.: 16/029,719

(22) Filed: Jul. 9, 2018

(51) Int. Cl.
*F41B 5/18* (2006.01)
*F41B 5/14* (2006.01)
*F41B 5/12* (2006.01)
*F41B 5/10* (2006.01)

(52) U.S. Cl.
CPC ..... *F41B 5/1469* (2013.01); *F41B 5/10* (2013.01); *F41B 5/12* (2013.01)

(58) Field of Classification Search
CPC ..... F41B 5/1469
USPC ..... 124/35.2
See application file for complete search history.

(56) References Cited

U.S. PATENT DOCUMENTS 3,060,625 A * 10/1962 Glass ..... F41C 9/00 446/26
4,426,989 A * 1/1984 Sutton ..... F41B 5/1469 124/35.2
5,261,581 A * 11/1993 Harden, Sr. ..... F41B 5/1469 124/23.1
5,435,291 A 7/1995 Woodward
5,448,983 A * 9/1995 Scott ..... F41B 5/1469 124/35.2
5,615,662 A * 4/1997 Tentler ..... F41B 5/1469 124/35.2
5,653,214 A * 8/1997 Lynn ..... F41B 5/1469 124/35.2
5,857,452 A * 1/1999 Troncoso ..... F41B 5/1469 124/35.2
5,937,841 A * 8/1999 Summers ..... F41B 5/1469 124/35.2
6,205,991 B1 * 3/2001 Summers ..... F41B 5/1469 124/35.2
6,481,431 B1 * 11/2002 Summers ..... F41B 5/1469 124/35.2
6,766,794 B1 7/2004 Bently
7,278,415 B2 * 10/2007 Jones ..... F41B 5/1469 124/35.2
D597,164 S 7/2009 Jones
(Continued)

*Primary Examiner* — Alexander R Niconovich
(74) *Attorney, Agent, or Firm* — Warner Norcross + Judd LLP

(57) ABSTRACT

An archery release including a release body, a wrist strap and a rigid length adjuster which enables multiple levels of adjustment to the distance between the wrist strap and the release body. The adjuster can be rotatable about two axes perpendicular to one another. The adjuster can include a connector that fixes the rotational orientation or the adjuster about the first axis. The adjuster can be rotated from an extended mode to a storage mode about the second axis. The adjuster can be further rotated about the first axis to engage an exterior contour of the adjuster against a ring associate with the wrist strap. This in turn arrests movement of the adjuster relative to the ring and strap, so the release body is in a stowed position proximate the wrist strap when the archery release is not in use. A method also is provided for operating an archery release.

20 Claims, 5 Drawing Sheets

(56) References Cited

U.S. PATENT DOCUMENTS

| | | | | |
|---|---|---|---|---|
| 7,753,043 | B1 * | 7/2010 | Eckert | F41B 5/1469 124/35.2 |
| 7,926,475 | B2 | 4/2011 | Jones | |
| 7,946,282 | B2 | 5/2011 | Jones | |
| 8,061,340 | B2 * | 11/2011 | Mitchell | F41B 5/1469 124/35.2 |
| 8,146,578 | B2 | 4/2012 | Jones | |
| D688,346 | S | 8/2013 | Jones | |
| D697,575 | S | 1/2014 | Jones | |
| D697,992 | S | 1/2014 | Jones | |
| 8,733,335 | B2 | 5/2014 | Pierce | |
| 8,746,222 | B2 * | 6/2014 | Jones | F41B 5/1469 124/35.2 |
| 8,746,223 | B2 * | 6/2014 | Jones | F41B 5/1469 124/35.2 |
| 8,869,781 | B2 * | 10/2014 | Jones | F41B 5/1469 124/35.2 |
| 9,032,943 | B1 * | 5/2015 | Coalson | F41B 5/148 124/35.2 |
| 9,612,077 | B2 | 4/2017 | Kelly | |
| 9,625,230 | B2 | 4/2017 | Kelly et al. | |
| 9,702,658 | B2 | 7/2017 | Horn | |
| 9,857,139 | B2 | 1/2018 | Kelly et al. | |
| 9,863,736 | B2 | 1/2018 | Kelly et al. | |
| D816,792 | S | 5/2018 | Kelly | |
| 9,970,731 | B2 | 5/2018 | Horn | |
| 2009/0090341 | A1 * | 4/2009 | Coughlin | F41B 5/1469 124/35.2 |
| 2013/0174821 | A1 * | 7/2013 | Jones | F41B 5/1469 124/35.2 |

* cited by examiner

ARCHERY RELEASE

BACKGROUND OF THE INVENTION

Conventional archery releases are designed to temporarily hold a bowstring of an archery bow so that an archer can pull on the release and subsequently draw the bowstring to shoot an arrow from the bow. Archery releases typically assist an archer in consistently releasing the bowstring when the archer shoots the arrow, and thus increase the accuracy of the shot.

Most releases include a head having one or more pivotable jaws that hold the bowstring, a trigger mechanism that actuates the jaws, and a wrist strap or handle configured so that an archer can hold the release. In use, an archer nocks an arrow on the bowstring and secures the jaws of the release around the bowstring or an associated loop. The archer then draws the bowstring by pulling the release. After the archer fully draws the bowstring, aims the bow and is prepared to shoot the arrow, the archer pulls the trigger. This moves the one or more jaws and subsequently disengages the bowstring so that the bowstring can utilize its stored energy and propel the arrow from the bow.

Many releases include an adjuster configured to accommodate the physical attributes of an archer, for example, hand size, draw length, finger length and the like. A common length adjuster is a solid multi-hole length adjuster. This adjuster includes a fastener that can be positioned in any one of multiple threaded holes. By threading the fastener in a preselected threaded hole, an archer can fix the distance of the release head from a wrist strap in a desired configuration.

There are several issues, however, with such multi-hole rigid adjusters. First, the threaded holes in a sleeve of the adjuster are set up in a spacing that is identical to spacing of holes in a stem to ensure proper positioning. This can limit the amount of overall length adjustment of the release. Second, the sleeves can be thin, so the fasteners might only thread into a thin piece of metal of the sleeve, which can lead to a weak connection between the sleeve and the stem. Third, the adjusters typically are rigidly attached at a pin projecting from a rigid plate on the wrist strap. Thus, the entire release body and adjuster are constrained to a limited range of movement. This, in turn, can prevent the release body from being precisely positioned according to the archer's preference. This construction also can place the release body in an undesirable forward facing position when the release is not in use, and the archer is engaged in another activity, such as traversing to an archery range or stand, reloading an arrow, adjusting a sight or other archery accessory, or climbing a tree.

Accordingly, there remains room for improvement in the field of archery releases.

SUMMARY OF THE INVENTION

An archery release is provided including a release body, a wrist strap and a rigid length adjuster that can enable precise adjustment of a distance between the wrist strap and the release body, and/or fixation of the release body relative to the strap.

In one embodiment, the rigid length adjuster can include a sleeve defining first set of holes and a stem defining a second set of holes. The first set of holes can be spaced differently from a second set of holes so as to increase the number of length adjustments available with the release.

In another embodiment, first holes in the sleeve can have first centers, and second holes in the stem can have second centers. The first centers can be spaced first distances from one another. The second centers can be spaced second distances from one another. The ratio of the first distance to the second distance can be optionally greater than 1:1, further optionally greater than 1:1.2, yet further optionally unequal to 1:1.

In still another embodiment, the first set of holes in the sleeve can be staggered differently relative to the second set of holes in the stem to micro adjust the length of the release from the wrist strap and to provide increased, incremental length settings.

In yet another embodiment, the stem or sleeve can be joined with a connector to a base joined with the wrist strap. The base can be rigid as can the connector. The connector can be configured to allow the stem or sleeve to rotate about a first axis so the head can be adjusted to a precise orientation relative to the user. The connector can be configured to allow the stem or sleeve to rotate about a second axis that is generally perpendicular to the first axis so the release can swivel to an extended mode and a storage mode.

In even another embodiment, the connector can include a bushing with a hole through which the sleeve or stem is placed. The hole can include a center aligned with the first axis. The bushing can include a set screw that can be selectively projected into the hole so the set screw can engage the stem or sleeve and prevent the same from rotating relative to the bushing about the first axis. The user can thus precisely adjust the release to lock the release body, jaws and/or trigger in a desired position relative to the user's hand and anchor point when in use.

In a further embodiment, the connector can include a base joined with a rigid plate or ring that is further attached to the wrist strap. The base can swivel about the second axis, allowing the remainder of the release joined with the connector to swivel from the extended mode to the storage mode.

In still a further embodiment, the adjuster can be configured to extend adjacent the rigid plate or ring when in the storage mode. For example, the adjuster can be swiveled about the second axis from an extended position in which the adjuster extends away from the ring, to a storage position in which the adjuster extends over a surface of the ring and is disposed adjacent the ring.

In yet a further embodiment, the rigid length adjuster can include a first exterior contour configured so that upon rotation of the release body to the storage mode from the extended mode, the adjuster has adequate clearance to rotate above the ring in a swivel plane that is disposed above the ring. Optionally the first exterior contour can be generally planar.

In even a further embodiment, the rigid length adjuster can include a second exterior contour, for example a cam surface, adjacent the first exterior contour. The adjuster can be rotated about the first axis while the adjuster is over the ring. This in turn engages the second exterior contour against a surface of the ring. With such engagement, the adjuster exterior surface can secure the release body or some portion thereof in an area over the ring, which allows the release to be stored in an out of the way storage mode when the release is not in use.

The current embodiments provide an archery release that enables an archer to precisely and consistently customize the release to the archer's physical stature and performance needs. Where the release includes a rigid length adjuster with offset holes in a sleeve and stem, the release can provide a large number of length adjustments to the user. Where the release includes an adjuster rotatable about a first axis relative to a connector, and the connector is further rotatable about a second axis relative to ring, the release head can be infinitely positioned according to a user's preference. Where the release includes a set screw or other fixation element in the connector, the precise rotational orientation of the release can be set to the user's preference. Where the release includes an adjuster with certain exterior contours, those contours can be moved to engage a plate to cleanly store the release body or some other portion of the release out of the way when the release is not in use, and when the archer is engaged in another activity.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention, any additional steps or components that might be combined with or into the enumerated steps or components.

DETAILED DESCRIPTION OF THE CURRENT EMBODIMENTS

Figure 1:
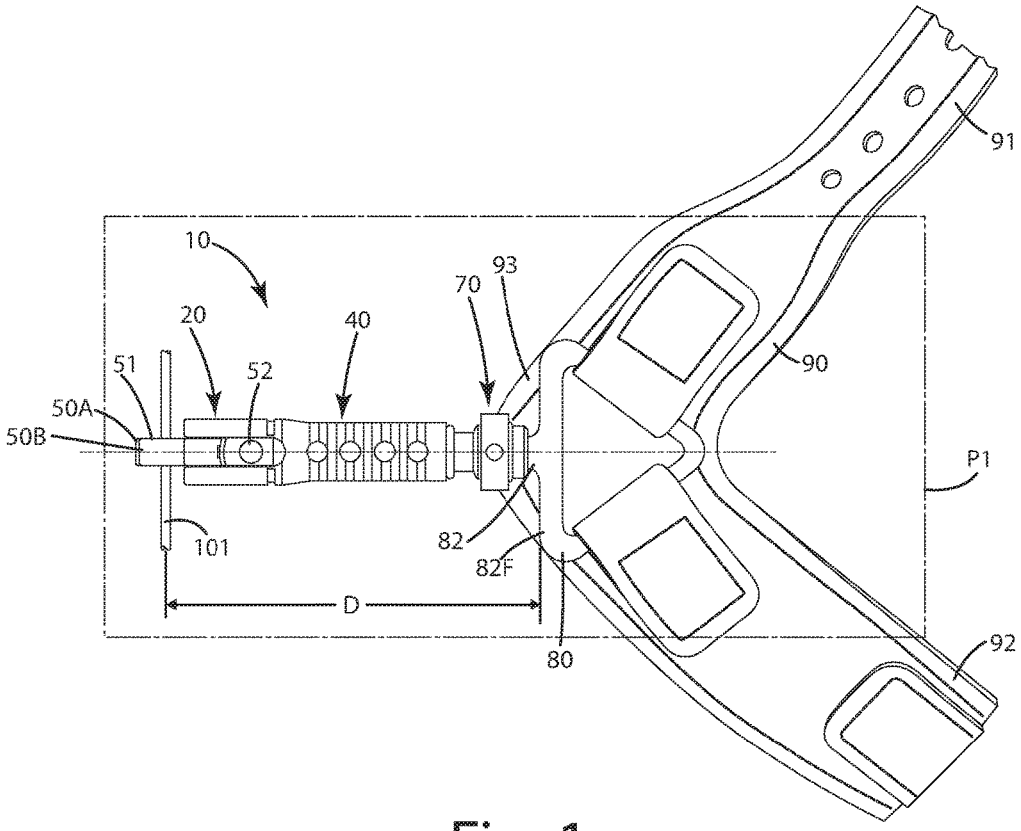
FIG. 1 is a top view of the archery release of a current embodiment in an extended mode and in a retracted length mode.

A current embodiment of the archery release is shown in FIGS. 1-5 and generally designated 10. The release 10 generally includes a release body 20 having a longitudinal axis LA, first and second movable jaws 50A and 50B, and a trigger 52. The release body 20 can be joined or integral with an adjuster 40 which, as illustrated, is a rigid length adjuster. The rigid length adjuster 40 can include a sleeve 41 and a stem or post 42 that can telescope relative to one another but can be held in a fixed orientation relative to one another via a fastener 43. The adjuster 40 can be joined with a connector 70, and rotatable about a first axis A1, which can be coincident with the longitudinal axis LA. The connector 70 can be rotatably joined with a ring 80 joined with the strap 90. The connector, adjuster and release body can be also rotatable in plane P1 about a second axis A2, which can be offset from and optionally perpendicular to the first axis A2. The adjuster can be rotated from an extended mode shown in FIG. 1 to a storage mode shown in FIG. 4 about the second axis A2, and further rotatable about the first axis A1, from a free, stored mode shown in FIG. 4 to a locked, stored mode shown in FIG. 5 where an adjuster surface 48, 40S2 engages the ring to impair rotation or movement of the adjuster, release body and components relative to the ring, so these items are out of the way when an archer is engaged in other activities.

The release can be used to assist the archer in drawing and releasing a bowstring 101. When the release is in a closed position, as shown in FIG. 1, and used to draw the bowstring 101, the bowstring 101 is captured in one or both of the bowstring notches 50A, 50B. The release 10 can be actuated from a closed position (FIG. 1) to an open position (FIGS. 2, 3) by an archer engaging and actuating the trigger 52.

The release can be operated to adjust the overall distance D of the release body 20, and/or its components, such as the movable jaws, bowstring notch, trigger and/or the like from the ring 80 to fit the archer's physical attributes and/or the particular bow with which the release is to be used. For example, the adjuster 40 can be selectively configurable to establish the overall distance D between the wrist strap and the release body 20 and/or its components, such as, the bowstring notch 52, as illustrated.

Figure 3:
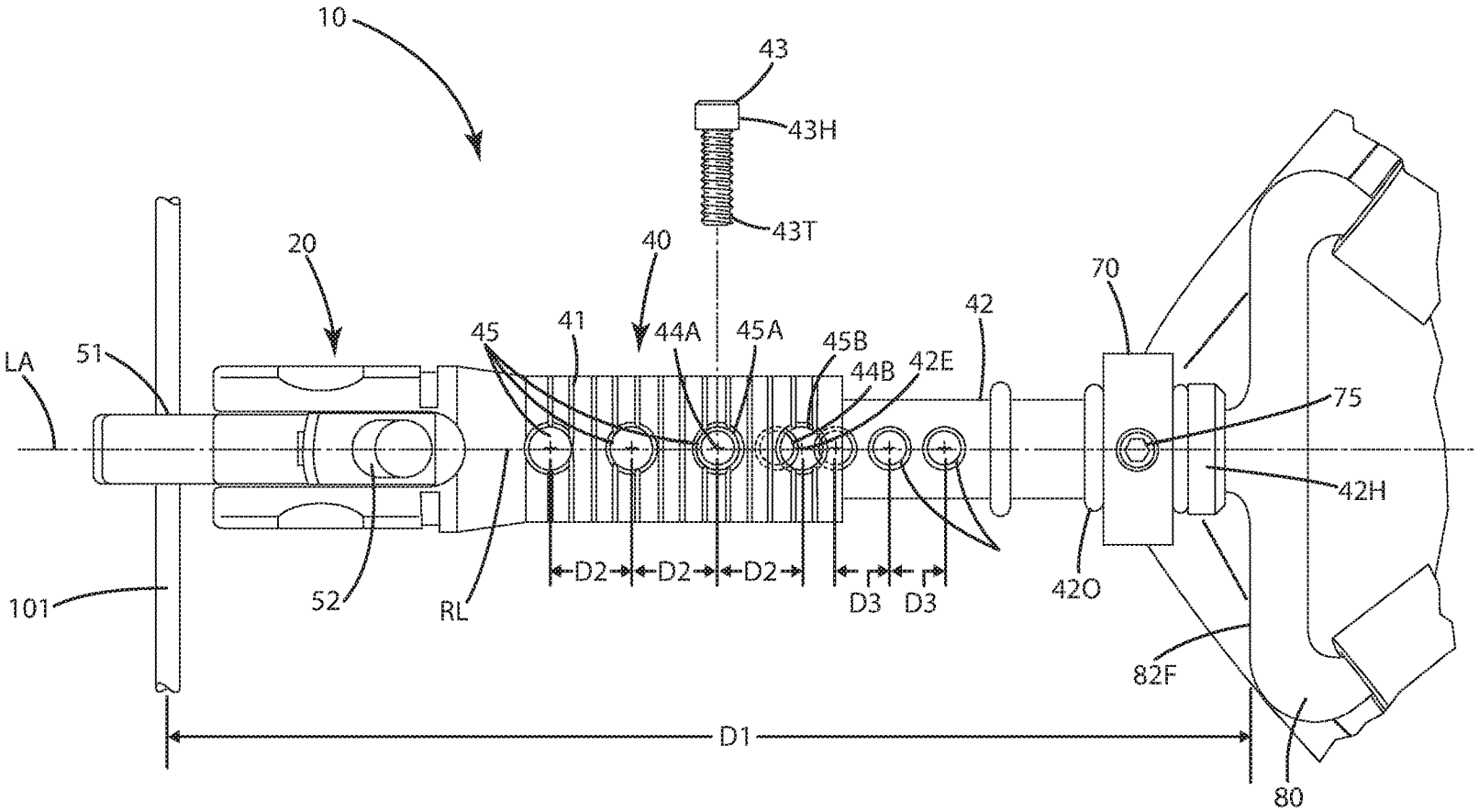
FIG. 3 is a top view of the release with a length adjuster in an extended length mode.

The release 10 can be extended from a retracted mode having an overall distance D between the ring 80, for example, its front surface 82F or some other portion, and bowstring notch 51, shown in FIG. 1, to one or more exemplary lengthened modes, shown in FIG. 3, where the overall distance D is increased to distance D1 or some other distance depending on the holes through which the fastener 43 is positioned. Optionally, the length of the adjuster 40 can be adjusted incrementally to set lengths due to the fixed nature of the adjustment mechanism of that adjuster, as described below.

Figure 4:
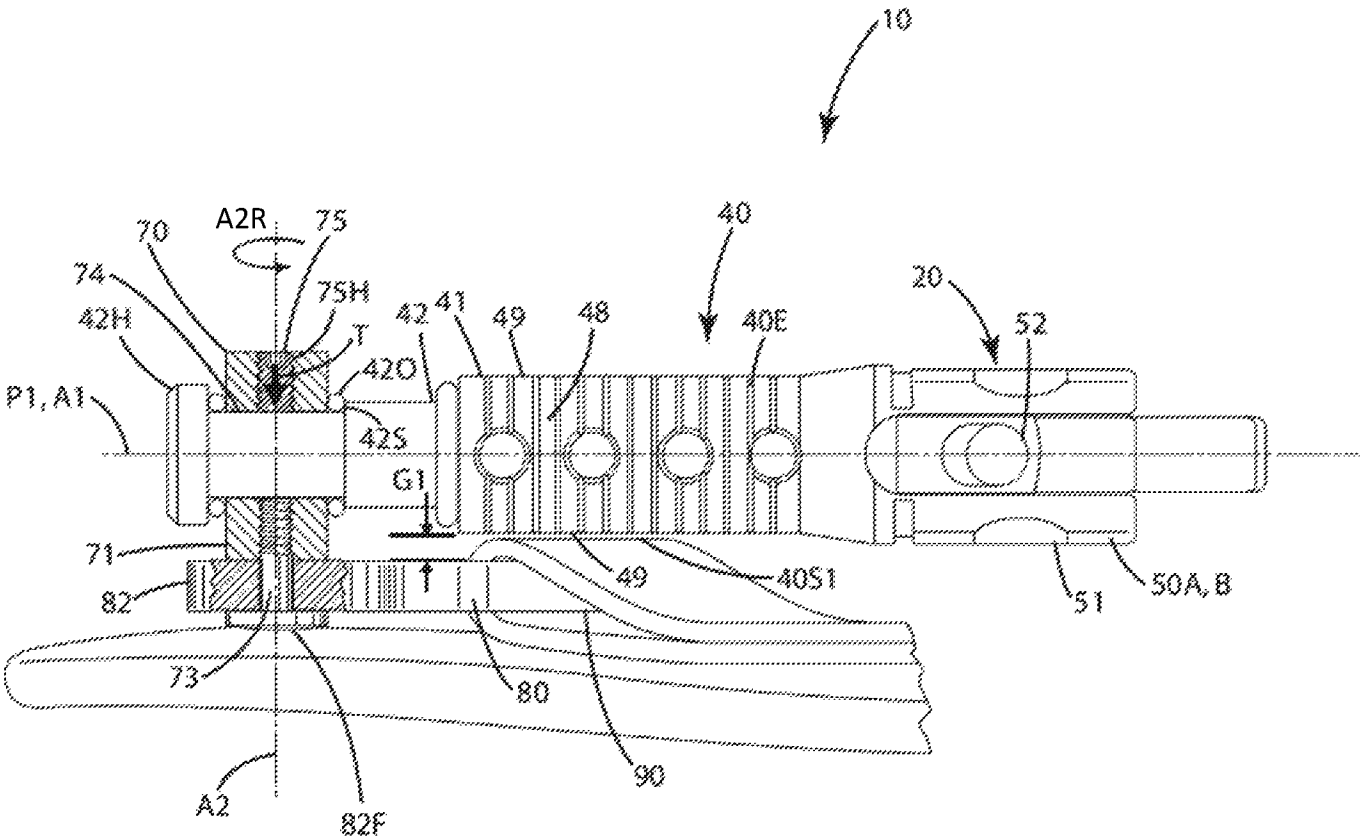
FIG. 4 is a side view of the release with the adjuster and release in a free storage mode.

The release 10 can be operated to convert the release from an extended mode (FIG. 1) to a storage mode (FIG. 4). In the extended mode, the adjuster 40 and release body 20 extend generally forward from the ring 80. While in the storage mode, the adjuster and release body can rotate backward about the second axis A2 so that they extend over the ring 80 and/or the wrist strap 90, so these elements are out of the way of the archer while the archer is engaged in some activity other than drawing an archery bow with the release 10. The adjuster and release body also can be converted from a free storage mode, shown in FIG. 4, where a first contour or surface 40S1, 49 of the adjuster 40 is free floating and/or generally movable above the ring 80, to a locked storage mode, shown in FIG. 5, where a second contour or surface 40S2, 48 of the adjuster is engaged with the ring 80 to impair or prevent movement of the release body and/or adjuster out from the storage mode shown there. This conversion can occur by rotating the adjuster and/or release body about the first axis A1, as described further below.

As used herein, "bowstring" refers to an actual bowstring of an archery bow and any device or component adapted to join with a bowstring of an archery bow and aid an archer in drawing or releasing the bowstring, including rope loops, which are attached to the bowstring above and below the location where an arrow nock rests, and receivers, for example, a metal loop or partial loop that is joined with the bowstring above and below, or only above, or only below, the location where the arrow nock rests on the bowstring.

As used herein "archery bow" refers to any compound bow, recurve bow, long bow, crossbow or any other device that propels or is capable of propelling an arrow, bolt or other similar projectile.

Further, although the releases illustrated and described herein are generally two jaw, dual caliper wrist strap releases, the constructions herein are well suited for any other type of archery release including, but not limited to, single caliper, single jaw releases, rope releases, back tension releases, thumb releases, plunger releases, pinky releases, releases with or without wrist straps, hunting releases, target releases and the like.

Referring to FIGS. 1-5, the components of the release 10 will now be described in detail. The release body 20 is generally elongate and includes movable jaws 50A, 50B and a trigger 52. The jaws and trigger can be positioned in a recess sufficiently sized to house all or a portion of these and other components of the release. The release body 20 can further define apertures to accommodate various pivot elements, such as pins, to join the trigger 52 and jaws 50A, 50B with the body 20 as desired.

Figure 2:
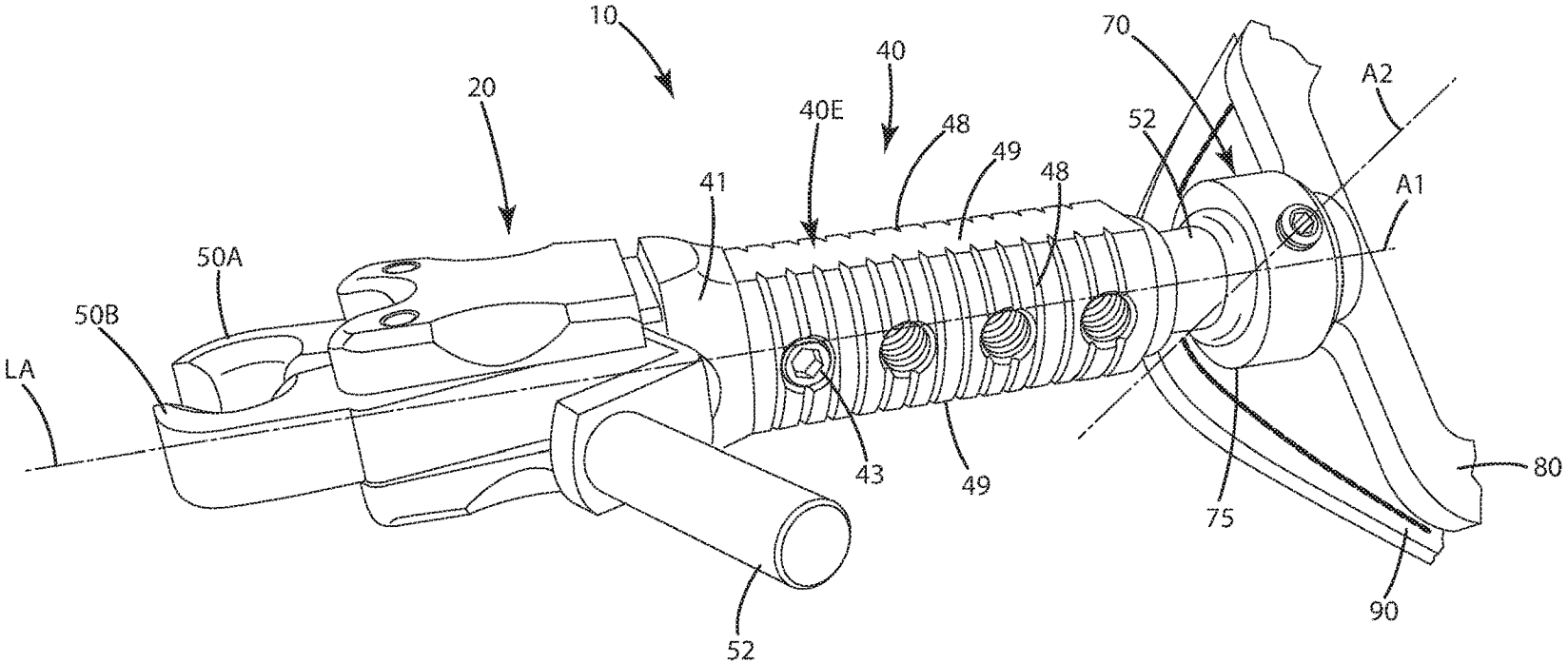
FIG. 2 is a perspective side view thereof.

The movable jaws 50A and 50B can be constructed in a variety of configurations. In general, a suitable construction enables the movable jaws to move away from one another, or more generally, it enables at least one jaw to move to release the bowstring from the bowstring notches 51. With reference to FIG. 2, the movable jaws can be pivotally mounted via pivot elements to the release body 20. At a rearward portion, a roller (not shown) can be joined with the movable jaw 50B. In general, the roller can engage a sear (not shown) of the trigger 52. A variety of other elements can be substituted for the roller, such as ball bearings, non-rotating elements, sliding elements or any structure that enables the movable jaws to open.

As shown in FIG. 1, the movable jaws 50A and 50B define one or more bowstring notches 51. The bowstring notches can include a curvilinear, planar or other smooth surface configured to minimize wear on a bowstring. The bowstring notches can be disposed along or can face the longitudinal axis LA of the release body 20. Each notch can be U- or V-shaped opening or recess defined by the movable jaws configured to capture at least a portion of the bowstring 101.

Between the movable jaws, or optionally the release body 20, a bias member (not shown), such as a coil spring, a leaf spring, a rubber or other elastomeric element, can be positioned to urge the movable jaws open when the trigger 52 is actuated from a holding mode to a triggered mode. Other mechanisms for performing similar or different movement can be substituted as desired.

The release 10 and its various components can be constructed from a variety of materials, for example, metal, such as steel, stainless steel and aluminum, as well as other synthetic materials such as polymers, and any combination of the foregoing. Further, the release 10 and its components can be treated with special processes, for example, anodizing, dipping, brushing, etching or filming to provide the release and its components with a desired finish and appearance.

As shown in FIGS. 1 and 2, the release body 20 can include a longitudinal axis LA which generally extends the length of the release body 20 and through the adjuster. This longitudinal axis LA typically can be aligned with and/or parallel to the forward travel path of a bowstring 101 as it is released from the release 10. Of course, in some circumstances, the longitudinal axis LA may not be perfectly aligned with the bowstring travel path, depending on the configuration of the bowstring and the archery bow to which it is attached. Optionally, the longitudinal axis LA can lay in a first plane P1 within which the release body and/or adjuster can rotate, for example, from an extended mode to a storage mode. The longitudinal axis LA also can be parallel to, aligned with and/or coincident with a first axis A1 of the adjuster 40 or connector 70 described below.

The release body 20 can be joined with or can include as an integral portion thereof an adjuster 40. This adjuster 40 can be in the form of a rigid structure including incrementally placed adjustment features that enable this adjuster and thus the release to be incrementally adjusted to fixed, preselected lengths. The adjuster 40 can include a sleeve 41 and a stem or post 42. The sleeve 41 can be in the form of an outer adjustment element of a tubular construction, and the second connector element 42 can be in the form of an inner adjustment element in the form of a stem or post. When in the form of a tube, the sleeve can be hollow and can be integrally formed with the release body and/or its components. In some cases, the sleeve can be of a cylindrical shape defining an inner bore within which the stem of like shape is slidably or telescopically fitted. The stem 42 can be joined with the connector 70 as described below. The stem can be a solid, elongated bar, slidably received in the tube forming the sleeve. The sleeve 41 and the stem 42 can be telescopingly engaged with one another so that when moved relative to one another, the sleeve 41 and stem 42 can telescope inward and outward, relative to or toward and away from one another, thereby changing the overall length of the first adjuster. Optionally, the sleeve and stem can be aligned and in parallel with the release body access LA, as well as the first axis A1.

As shown in FIGS. 1 and 2, the adjuster 40 with its sleeve and stem, can extend somewhere between the release body 20 in the ring 80, or wrist strap 90, where the adjuster 90, for example, the stem, can be joined with the connector 70. As will be appreciated, the sleeve and stem in the relative locations to other components can be reversed, for example, the sleeve can be joined with the connector and the stem can be joined with the release body. These parts alternatively can be joined with other parts of the release. Further, the holes and other components of each of these members can be mixed and matched with these members, depending on the application.

With reference to FIGS. 1 and 3, the sleeve 41 can define a plurality of first holes 45 set at incremental first distances D2 from one another in a fixed rigid structural relationship relative to one another. These first distances D2 can be measured from the geometric centers of the first holes or bores that extend through parts of the sleeve. These holes 45 can lay along and/or project through the longitudinal axis LA of the release 10. Generally the centers of these holes 45 are aligned along a reference line RL that is parallel to the longitudinal axis LA. This reference line can be substantially linear and straight. Optionally, these holes 45 can be threadless, that is, generally without threads that enable these holes to interface with threads of a fastener 43. Of course, in certain applications, these holes 45 can include threads. Some of the holes 45 can be sized differently to receive the head 43H or the tip 43T of the fastener 43.

The stem 42, shown as an elongated bar or post, can define a plurality of second holes 44 each disposed a second distance D3 from one another. These holes 44 can lay along and/or project through the longitudinal axis LA of the release 10. Generally the centers of these holes 44 are aligned along the reference line RL that is parallel to the longitudinal axis LA. Optionally, these holes 44 through the stem can be threaded so that they can threadably engage the threaded portion of the fastener 43.

As illustrated in FIG. 3, the plurality of first holes 45 are spaced differently than the plurality of second holes 44. For example, the distance D2 is unequal to the distance D3 that separates the respective holes. In some cases, the distance D2 can be greater than the distance D3. In other cases, the distance D3 can be greater than the distance D2. Generally, the first distance D2 and the second distance D3 can be comparatively expressed in a ratio, optionally greater than 1:1, further optionally greater than 1.2:1, further optionally greater than 1.5:1. Other ratios can express the relationship between the first distance and the second distance. Optionally, this ratio is greater than or less than or otherwise unequal to 1:1.

With further reference to FIG. 3, the different distances D2 and D3 between the respective holes 45 and 44 results in many holes of the first and second sets of holes being misaligned with one another if any one of the individual holes from those two sets of holes is aligned. For example, when an individual first hole 45A is aligned with an individual second hole 44A to place a fastener 43 therethrough, an adjacent first hole 45B is misaligned with an adjacent second hole 44B. In this manner, the exterior surface 42E of the stem 42 adjacent the hole 44B is exposed and viewable through the first hole 45B.

As mentioned above, the fastener 43 can be positioned through one of the first holes and one of the second holes to secure the sleeve to the stem. Optionally, where any two holes, one from the first set and one from the second set, are aligned, the majority of the other holes from the first set and the second set can be misaligned so that the stem shows through the first set of holes in the sleeve. This misalignment of first holes in the sleeve and second holes in the stem can prevent other additional fasteners from being engaged through the stem and sleeve to rigidly fix the length of the adjuster.

The components of the adjuster 40, and optionally the connector 70, all can be constructed of a rigid and inflexible material. Suitable material can include metals, hard polymers, composites and combinations of the foregoing. When the adjuster 40 is constructed of rigid materials and defines fixed distance incrementally spaced holes, the adjustments of the first adjuster 40 generally can be incremental, that is, the length of the first adjuster 40 can be set in specific predefined increments, for example, 1/16 inch, 1/8 inch, 1/4 inch, 1/2 inch or other fixed lengths as desired.

The release 10 can be configured to enable the release body 20 to swivel or rotate relative to the connector 70 and/or the ring 80. This optionally can be accomplished via the connection of the adjuster 40 to the connector 70 and/or the connector 70 to the ring 80. As will be appreciated, although shown as a triangular-shaped ring with an open hole in the middle, this ring 80 need not be in the form of a perfect ring. For example, it can be in the form of a plate or part that is fastened, stitched, welded or otherwise joined with the wrist strap 90. It may or may not be concealed under or within fabric or material of the wrist strap, and it may or may not define a hole or opening.

As shown in FIG. 4, the connector 70 can be in the form of a bushing joined with the ring 80. The bushing or connector 70 can define a hole 74 that defines or otherwise includes the first axis A1. This hole can be cylindrical, as can be the stem 42 that fits within and/or through it. The stem 42 can be rotatably mounted in the hole and rotatable about the first axis A1. With this configuration, an archer can rotate, move and/or otherwise orient the release body and its components to preselect a configuration relative to the first axis A1 by rotating the release body including the movable jaw about the first axis A1.

Optionally, the bushing or connector 70 can include a projection 75 movable to selectively engage the adjuster to impair rotation of the adjuster relative to the bushing or connector about the axis A1. The projection can be in the form of a fastener 75, which can be a set screw, that is selectively engageable against the adjuster 40, and in particular, the stem 42 to prevent rotation of the adjuster and/or the release body. The fastener 75 can thread into the threaded hole 75H to engage the adjuster 40. By tightening the fastener 75 in the direction T, the fastener 75 abuts and engages the stem 42. By sufficiently tightening the fastener 75, an archer can effectively lock the stem 42 in a fixed rotational orientation relative to the first axis A1, to the connector or bushing 70. Thus, the adjuster and release body can be fixed and stationary relative to the connector about the first axis A1. Of course, if an archer desires rotation of the release body about the axis A1, the set screw can be left untightened, so it does not engage the stem or the adjuster.

Optionally, as shown in FIG. 4, the adjuster, in particular, the stem 42 can include certain elements to retain the adjuster, and in particular, the stem 42, in attachment with the connector 70. As an example, the stem 42 can define a shoulder 42S. An o-ring 42O can be placed adjacent the shoulder and abut the connector 70 on one side of the connector. On the opposite side of the connector 70, the stem can include a head 42H but also abuts that side of the connector. In this manner, the stem 42 can be constrained in the bushing 70 but can still rotate about the first axis A1.

As further shown in FIG. 4, the connector 70 can include a base 71 that is secured to the ring 80. The ring 80 can include a forward facing finger 82 that projects out the front surface 82F of the ring 80. The base 71 can be secured with a fastener 73 to the ring 80. The fastener can be secured in such a manner such that the connector 70 can swivel and rotate about the axis A2, in direction A2R. As a result, the associated adjuster 40 and release body 20 also swivel and rotate in direction A2R.

Optionally, the first axis A1 and second axis A2 can have a particular spatial relationship with one another. Generally, the first axis A1 is offset from the second axis A2 at some particular angle. In some applications, the first axis can be perpendicular to the second axis. These axes can optionally intersect one another. The first axis, as mentioned above, also can lie within a first plane P1 and can further be rotated or move within that first plane P1.

As mentioned above, and with reference to FIGS. 2 and 4, the connector 70 can be joined with the ring 80 and can be rotatable about the second axis A2 which is offset from the first axis A1. The connector can be rotated to configure the release body and/or adjuster in an extended mode, shown in FIGS. 1 and 2, where the same extend generally forward of the ring 80, and a storage mode, shown in FIGS. 4 and 5, where the adjuster and/or release body is located adjacent and/or over the ring 80. For example, the adjuster 40, in particular, the stem and/or sleeve, can be disposed over the upper surface 88 of the ring 80. Optionally, in converting from the extended mode to the storage mode, these elements can rotate or otherwise move in the first plane P1 above or adjacent the ring while these components rotate in the direction A2R about the second axis A2.

Figure 5:
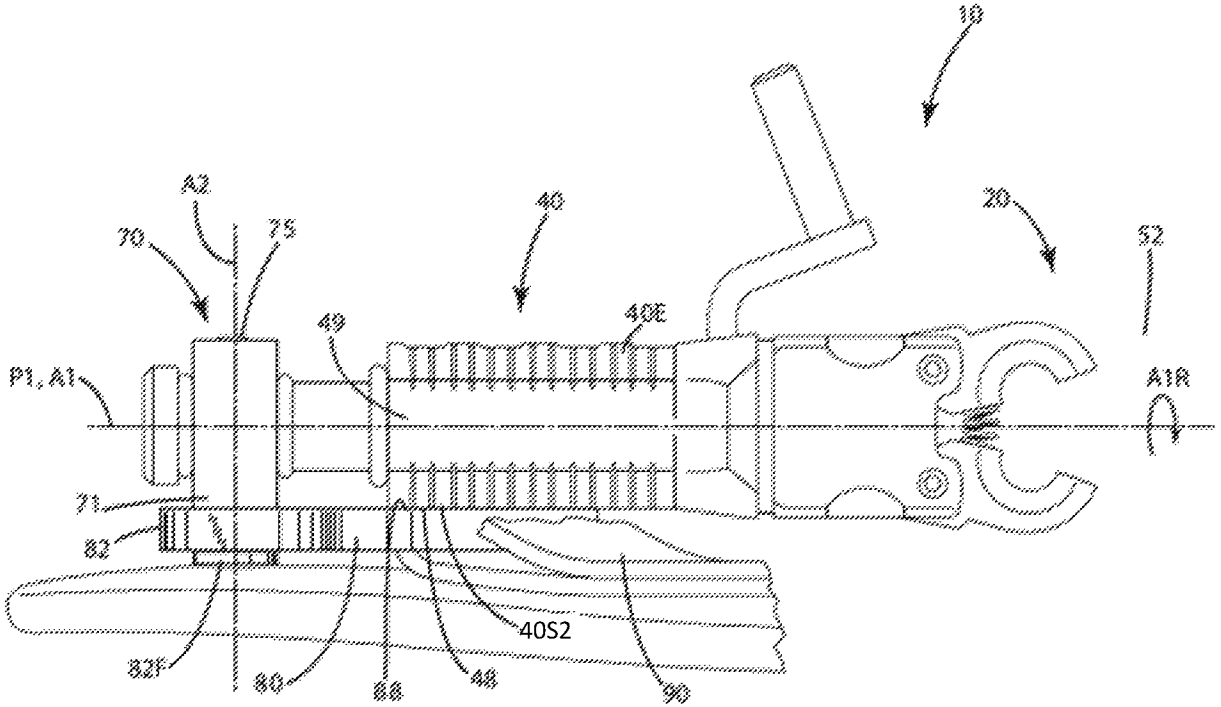
FIG. 5 is a side view of the release with the adjuster and release in a locked storage mode.

When in the storage mode, the adjuster 40 and release body 20 can be rotated about the first axis A1 to achieve other modes, for example, a free storage mode (FIG. 4) or a locked storage mode (FIG. 5). These modes can be achieved with the help of a first contour 49 and a second contour 48 on the release, and optionally associated with the exterior surface 40E of the adjuster 40. For example, the second contour 48 can be a camming surface that can be slightly rounded, or generally less flat than the first contour 49. The first contour 49 optionally can be planar and generally flat. Of course in other cases, the first and second contours can be combined to form a generally elliptical cross-section of the adjuster 40. Optionally, the exterior surfaces of the sleeve 41 can include these contours or surfaces. Of course, in other applications, the release head and/or stem can include these or other contours.

In some applications, the first contour and the second contour can be offset relative to one another. For example, the first contour and second contour can be offset from one another optionally 90°, further optionally 60°, yet further optionally 180°, yet further optionally 120° or other angular orientations about the first axis A1. The first contour and the second contour can also be paired, so that a pair of the first contours lays across one another from the first axis A1, and a second pair of the second contours lays across one another from the first axis A1. Of course, there may be any number of the first contours and second contours, or even other contours disposed around the first axis A1, depending on the function of the adjuster to engage the ring and temporarily secure the adjuster and release body in the locked storage mode.

With reference to FIG. 4, the adjuster and release are in the free storage mode, in which the adjuster and release body are configured to be rotated about the second axis A2 for example in direction A2R. The adjuster can be rotated so that it freely moves over the ring, optionally above the upper surface 88 of the ring 80, optionally moving within the plane P1. As shown there, the first flat planar surface 49 is separated by a gap G1 from the ring 80, and in particular, the upper surface 88 of the ring. Thus, there is no interference between that first surface 49 and the ring 80 to prevent or otherwise impair rotation of the adjuster and release body over the ring in that free storage mode.

With reference to FIG. 5, the adjuster and release body are configured to be rotated about the first axis A1 in direction A1R, while the adjuster and release body are in the storage mode so as to engage a portion of the release 10 against the ring and thereby hold the adjuster in the storage mode, for example, in a locked storage mode. In this locked storage mode, the second contour, for example, a camming face 48, can cam against the ring 80, for example, the upper surface 88, to impair rotation of the release body and the adjuster about the second axis A2. Due to the friction and engagement of the second contour or second face against the ring, the release body and adjuster are impaired from rotating about the first axis A1 until the archer further rotates the adjuster to disengage the second contour from the ring.

Generally, the adjuster is configured to be rotated about the second axis A2 while the first contour or planar face faces toward the ring because the planar face or first contour does not engage the ring to prevent such rotation. The adjuster is configured to not be rotated—or otherwise is prevented from rotating about the second axis A2 while the second contour or camming face faces toward the ring because that contour engages the ring to prevent such rotation. Optionally, during rotation of the adjuster 40 about the second axis A2, the first axis A1 remains a fixed distance from the upper surface of the ring. The first contour is disposed a second distance below the first axis A1 that is less than the fixed distance. However, when the adjuster is rotated about the first axis, the second contour is disposed below the first axis A1. The second contour, however, extends a third distance below the first axis A1. This third distance is equal to or greater than the fixed distance. Accordingly the second contour can functionally engage the ring.

The wrist strap 90 of the release 10 can be constructed of a generally flexible material and adapted to wrap around an appendage, such as a wrist, a forearm, and/or a hand of an archer. The wrist strap 90 can be constructed from leather, plastic, fabric, and/or other materials or composites depending on the desired look and feel of the wrist strap. As shown in FIG. 1, the wrist strap 90 can include a first portion 91 and a second portion 92, generally joined with one another at an apex 93 of the strap 90. These portions can be configured to attach with one another when wrapped around the appendage of an archer, for example, a wrist, forearm or hand of an archer. Generally, when the wrist strap 90 is attached to the archer, it can form a tear drop shaped loop. With this construction, the release body and adjusters generally can be forward facing from the apex 93 of the wrist strap 90. These components can be further oriented relative to the appendage and/or hand of the wearer based on preference. Although the wrist strap 90 is illustrated as a buckle-type wrist strap, other wrist strap configurations can be substituted in the archery release 10.

Operation of the release 10 will now be described with reference to FIGS. 1-6. As mentioned above, the release 10 can be operated to adjust a distance D between the ring 80 in the bowstring notch 51, or to otherwise adjust placement of the trigger 52 relative to the archer's body. This fits the release to the archer's hand size, wrist size, draw length, or other physical characteristics. This distance D can be modified by removing the fastener 43 from one hole and moving the sleeve 41 relative to the stem 40 while the fastener is removed. The fastener can be replaced to set the distance at a new distance D1, as shown in FIG. 3. Again, with the first holes 45 being spaced differently from the second holes 44, a variety of multiple different length adjustments can be made incrementally.

Archer's also can adjust the angular orientation of the adjuster and release body, and thus, the trigger and bowstring notch relative to the ring 80 via the connector 70. For example, the user can tighten or loosen the fastener 75 to engage the stem 42 and effectively lock the adjuster and release body and trigger in a fixed angular relationship relative to the connector and thus the ring. Of course, if the archer desires the adjuster and release body and trigger to rotate freely relative to the connector in use, that set screw is not tightened.

When these adjustments are made, the archer can attach the strap so the wrist strap forms a loop around the rest of the archer. The archer can then utilize the release to pull on the bowstring 101 and release it. When the archer no longer desires to use the release to engage a bowstring, the release 10 can be converted from the extended mode shown in FIG. 2 to the storage mode shown in FIGS. 4 and 5. To do so, the archer can engage the adjuster and/or the release body and rotate the same in direction A2R about the second axis A2 so that the adjuster and release body move or rotate within the plane P1, backward over the ring 80, and in particular, the upper ring surface 88 are generally over the wrist strap. To do so, the adjuster can be configured so that the first contour 49 faces toward the ring as shown in FIG. 4. Thus, the adjuster and release are in the free storage mode and can freely rotate over and about relative to the ring 80.

To better secure the release in this mode and impair rotation back toward or in front of the ring to an extended mode, the archer can rotate the adjuster 40 and/or the release body 20 about the axis A1. As a result, shown in FIG. 5, the second contour 48 engages or optionally cams against the upper surface 88 of the ring 80. This, in turn, causes friction between the adjuster and the ring so that the adjuster and the release in general is in a locked storage mode, impaired from rotating back to the extended mode.

To release the adjuster from this mode, the archer can simply further rotate the adjuster so that the first contour 49 again faces the ring to establish a gap G1. The archer can then rotate the adjuster and release body further in direction A2R about the axis A2 so that the release is again readied for use and engagement with a bowstring.

In general, components of the release, such as the release body, adjuster, ring and connector can be molded, machined and/or extruded to obtain their desired configuration. These components can also be treated with special processes as described above to provide a desired finish. Other components, such as the wrist strap can be molded, extruded, die cut, and/or sewn to construct them. With the components constructed, the release 10 is assembled.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z. Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The invention claimed is:

1. An archery release comprising:

a release body having a longitudinal axis;

a movable jaw joined with the release body, the movable jaw movable between a first position and an second position, the movable jaw defining a bowstring notch configured to restrain a bowstring in the first position;

a wrist strap configured to engage an archer;

a ring joined with the wrist strap, the ring including an upper surface; and an adjuster extending between the ring and the release body, the adjuster configured to establish a preselected incremental distance between the bowstring notch and the ring; and a connector joined with the adjuster, the connector restraining the adjuster to swivel in only a swivel plane that is disposed above the upper surface of the ring, from an extended mode to a storage mode.

2. The archery release of claim 1, wherein the adjuster includes a sleeve defining a plurality of first holes, ones of the plurality of holes spaced a first distance from one another, the adjuster including a stem defining a plurality of second holes, ones of the plurality of second holes spaced a second distance from one another, the first distance being different from the second distance, the adjuster including a fastener selectively positionable through one of the plurality of first holes and one of the plurality of second holes, wherein the sleeve is a tube, wherein the stem is an elongated bar slidably received in the tube, wherein the plurality of first holes are threadless, wherein the plurality of second holes are threaded, wherein the fastener is threaded, wherein the fastener extends through and is threadably engaged with one of the plurality of second holes, wherein the fastener extends through but does not threadably engage one of the plurality of first holes.

3. The archery release of claim 1, wherein the connector comprises a bushing joined with the ring, wherein the adjuster is joined with the ring via the connector and is rotatable about a first axis, wherein the bushing includes a set screw that is selectively engagable against the adjuster to prevent rotation of the adjuster, whereby a user can selectively fix the adjuster in a fixed rotational orientation relative to the bushing.

4. The archery release of claim 3, wherein the adjuster is disposed in a first hole defined by the bushing, wherein the bushing defines a threaded hole that intersects the first hole, wherein the set screw is configured to thread into the threaded hole and engage the adjuster when the adjuster is in the first hole to hold the adjuster in a stationary position relative to the bushing.

5. The archery release of claim 1, wherein the adjuster includes an exterior surface including a first contour and a second contour different from the first contour, wherein the adjuster is rotatable about a first axis that is restrained to travel only in the swivel plane;

wherein the adjuster is configured to rotate about a second axis from an extended mode during use of the release to a storage mode when the release is not in use, wherein the adjuster is configured to rotate about the first axis when the adjuster is in the storage mode, such that the second contour engages the ring to rotationally lock the adjuster about the second axis so that the adjuster is impaired from being configured to the extended mode.

6. The archery release of claim 1, wherein the adjuster is configured to be rotated from an extended mode forward of the ring to a storage mode over the upper surface of the ring about a second axis, wherein the second axis is perpendicular to the swivel plane.

7. The archery release of claim 1,
wherein the adjuster is rotatable about a first axis relative to the ring,
wherein the first axis is perpendicular to a second axis,
wherein the adjuster includes an exterior surface including a planar face and a camming face,
wherein the adjuster is configured to be rotated about the second axis, while the secondary axis remains restrained in the swivel plane, and while the planar face faces toward the ring because the planar face does not engage the ring,
wherein the adjuster is configured to not be rotated about the second axis, while the second axis remains restrained in the swivel plane, and while the camming face faces toward the ring because the camming face engages the ring.

8. The archery release of claim 1,
wherein the connector includes a hole defining a first axis,
wherein the adjuster is rotatably mounted in the hole, and rotatable about the first axis,
whereby an archer can orient the movable jaw to a preselected configuration relative to the first axis by rotating the release body including the movable jaw around the first axis.

9. The archery release of claim 1,
wherein the adjuster includes a stem, the stem extending through a hole defined by the connector and rotatable about a first axis that remains in the swivel plane as the adjuster swivels.

10. The archery release of claim 1,
wherein the swivel plane is parallel to the upper surface of the ring.

11. The archery release of claim 1,
wherein the swivel plane is perpendicular to an axis of rotation of the connector.

12. An archery release comprising:
a release body;
a movable jaw defining a bowstring notch that is configured to restrain a bowstring, the movable jaw joined with the release body;
a wrist strap configured to engage an archer;
a ring joined with the wrist strap; and
a connector joined with the release body and the wrist strap, the release body rotatable about a first axis of the connector, the connector rotatable about a second axis relative to the ring; and
an adjuster extending between the ring and the release body,
wherein the adjuster is configured to be rotated about the second axis while a first face faces toward the ring because the first face does not engage the ring,
wherein the adjuster is configured to not be rotated about the second axis while a second face faces toward the ring because the second face engages the ring
wherein the first axis remains disposed in a first plane that is adjacent the ring, as the release body and adjuster rotate about the second axis, in that first plane, from an extended mode to a storage mode.

13. The archery release of claim 12,
wherein the release body includes a release body longitudinal axis that is aligned with the first axis,
wherein the release body is joined with the connector via a rigid length adjuster including a plurality of holes,
wherein the first face is flatter than the second face,
wherein the second face cams against the ring to impair rotation of the release body and the adjuster about the second axis,
whereby the release is impaired from converting from a storage mode to an extended mode.

14. The archery release of claim 12,
wherein the connector is a bushing defining a hole,
wherein the release body is joined with a rigid adjuster having a sleeve and a stem, the adjuster extending at least partially through the hole.

15. The archery release of claim 14,
wherein the rigid adjuster is rotatable with the release body about the first axis,
wherein the adjuster is extendable to vary a distance between the release body and the ring,
wherein first face is a planar face,
wherein the second face is a rounded face.

16. The archery release of claim 14,
wherein the connector defines a set screw hole that intersects the hole of the connector,
wherein a set screw is configured to selectively engage the rigid adjuster to impair rotation of the rigid adjuster relative to the bushing.

17. The archery release of claim 12,
wherein the release body is joined with an adjuster having a sleeve and a stem, the adjuster extending at least partially through the hole,
wherein the adjuster included a sleeve defining a plurality of first holes, ones of the plurality of holes spaced a first distance from one another, the adjuster including a stem defining a plurality of second holes, ones of the plurality of second holes spaced a second distance from one another, the first distance being different from the second distance, the adjuster including a fastener selectively positionable through one of the plurality of first holes and one of the plurality of second holes to establish a preselected incremental distance between the bowstring notch and the ring.

18. A method for operating an archery release comprising:
providing an archery release including a release body, a movable jaw joined with the release body, an adjuster joined with the release body and extending to a connector, and a ring joined with the connector and a wrist strap;
attaching the wrist strap to an archer so the wrist strap forms a loop around an appendage of the archer; and
rotating the adjuster about a first axis while the release is already in a storage mode and adjacent the ring, to move a first surface away from the ring and cam a camming surface of the release against the ring to thereby impair the release from converting from the storage mode to an extended mode.

19. The method of claim 18 comprising:
rotating the adjuster about a second axis to convert the release from an extended mode to a storage mode in which the adjuster extends over the ring.

20. The method of claim 19,
wherein during the rotating the adjuster about the second axis, a flattened surface moves over the ring in a plane,
wherein during the rotating the adjuster about the first axis, the flattened surface and the camming surface move the same angular amount.

* * * * *